US005241996A

United States Patent [19]

Werner, deceased et al.

[11] Patent Number: 5,241,996

[45] Date of Patent: Sep. 7, 1993

[54] APPARATUS FOR FILLING LIQUID INTO CONTAINERS

[75] Inventors: Heckmann Werner, deceased, late of Dortmund, by Peter Heckmann, executor; Siegmar Sindermann, Kamen-Heeren; Thomas Stolte, Dortmund, all of Fed. Rep. of Germany

[73] Assignee: Holstein und Kappert Aktiengesellschaft, Dortmund, Fed. Rep. of Germany

[21] Appl. No.: 967,926

[22] Filed: Oct. 28, 1992

Related U.S. Application Data

[63] Continuation-in-part of Ser. No. 702,224, May 17, 1991, abandoned.

[30] Foreign Application Priority Data

May 19, 1990 [DE] Fed. Rep. of Germany ..... 4016191

[51] Int. Cl.[5] ..... B67C 3/26; B67C 3/06

[52] U.S. Cl. ..... 141/39; 141/302

[58] Field of Search ..... 141/6, 39, 40, 44–46, 141/51, 59, 301, 302, 308

[56] References Cited

U.S. PATENT DOCUMENTS

| | | | |
|---|---|---|---|
| 2,063,326 | 12/1936 | Meyer | 141/302 X |
| 2,597,943 | 5/1952 | Meyer | 141/39 |
| 3,143,151 | 8/1964 | Denis | 141/46 X |
| 3,757,835 | 9/1973 | Copping | 141/39 X |
| 3,834,428 | 9/1974 | Rademacher | 141/39 |
| 4,086,943 | 5/1978 | Fernandez | 141/39 |
| 4,089,353 | 5/1978 | Antonelli | 141/302 |
| 4,103,721 | 8/1978 | Noguchi | 141/6 |
| 4,201,249 | 5/1980 | Borstelmann | 141/39 |
| 4,750,533 | 6/1988 | Yun | 141/46 |

FOREIGN PATENT DOCUMENTS

| | | | |
|---|---|---|---|
| 0238059 | 1/1965 | Austria | 141/46 |
| 0308721 | 3/1989 | European Pat. Off. | 141/39 |
| 2832325 | 1/1980 | Fed. Rep. of Germany | 141/39 |
| 1246555 | 10/1960 | France | 141/301 |

*Primary Examiner*—Henry J. Recla
*Assistant Examiner*—Casey Jacyna
*Attorney, Agent, or Firm*—Anderson Kill Olick & Oshinsky

[57] ABSTRACT

In an apparatus for filling liquid into containers subject to counter pressure, parts of the apparatus which could initiate turbulences are located out of the path of liquid flow. The displacement of the part out of the path of flow is significant in beverages containing fruit pulp and in other beverages. The apparatus includes springs providing weight compensation for a movable valve body and a gas valve. These springs are located above the liquid level in the vessel and bear against an abutment face on the valve body and on the gas valve.

2 Claims, 1 Drawing Sheet

APPARATUS FOR FILLING LIQUID INTO CONTAINERS

This is a continuation-in-part of application Ser. No. 07/702,224, filed May 17, 1991, now abandoned.

BACKGROUND OF THE INVENTION

The present invention is directed to an apparatus for filling liquid into containers, such as bottles, subject to counter pressure. The liquid is located in a vessel with a liquid outlet channel at its base. The liquid is introduced into the vessel through its top. A valve seat is located at the liquid outlet channel and a valve body is located in the vessel and cooperates with the valve seat in forming a closure of the liquid outlet channel. The valve member is movable in the upward direction under spring loading. A spring encircles the valve body within the vessel and during pressure equalization between the container and the vessel affords compensation of the weight of the valve body which compensation initiates the automatic opening stroke.

Such filling apparatus are used, in particular, for filling liquids containing $CO_2$ introduced from a pressure vessel into the bottle or other container connected with the filling valve. Pressure compensation between the bottle and the liquid vessel is achieved before the commencement of the filling step, so that the liquid flows into the bottle under a given head. During this process the gas contained in the bottle is displaced by the liquid into the gas space or the portion of the vessel located above the liquid level. For this purpose there is a gas return to which determines the end of the filling process as soon as the liquid reaches the lower end face of the tube. At this point an exchange of the gas back into the vessel is no longer possible. To compensate for the inherent weight acting on the filing valve body during pressure compensation, a compression spring is provided in valves of this type which assist in the opening process. A filling valve is of this type is disclosed in DE-OS 38 23 959. In this known arrangement, the spring affording pressure compensation is located below the liquid level in the vessel and rests at its lower end on appropriate abutments. The upwardly facing end of the spring rests against a protrusion on the movable valve body and assists its movement into the open position during the above described opening process.

SUMMARY OF THE INVENTION

Based on this known filling valve, the primary object of the present invention is to provide the region of the filling apparatus located in the flow path of the liquid free of turbulence generating components and, at the same time, avoiding the use of components, which apart from a negative increase of resistance to flow, would cause additional disturbance in filling liquids such as beverages containing fruit pulp or other additive content materials.

In accordance with the present invention, in a filling vessel of the type described above, the springs providing weight compensation abut, at a lower end, on a part of the filling apparatus located above the liquid level and, at the upper end, contact an abutment face of the movable valve body.

Further, it is appropriate that this same part also serves as an abutment face for another spring of the gas valve for the gas line arranged within the movable valve body.

As compared to known filling apparatus, an additional advantage is achieved in that all turbulence initiating components or parts are located above or outside the flow region of the liquid thus assuring a considerably improved flow characteristic. Simultaneously, such components, which tend to favor adhesion of fruit pulp especially in beverages containing such pulp, are located above the liquid level so that no problem develops. There is a further advantage where even with low viscosity present in beverages with certain additives and content materials, the filling time is not adversely affected. On the contrary, an additional increase of the flow velocity can be expected, due to the arrangement of the apparatus embodied the present invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
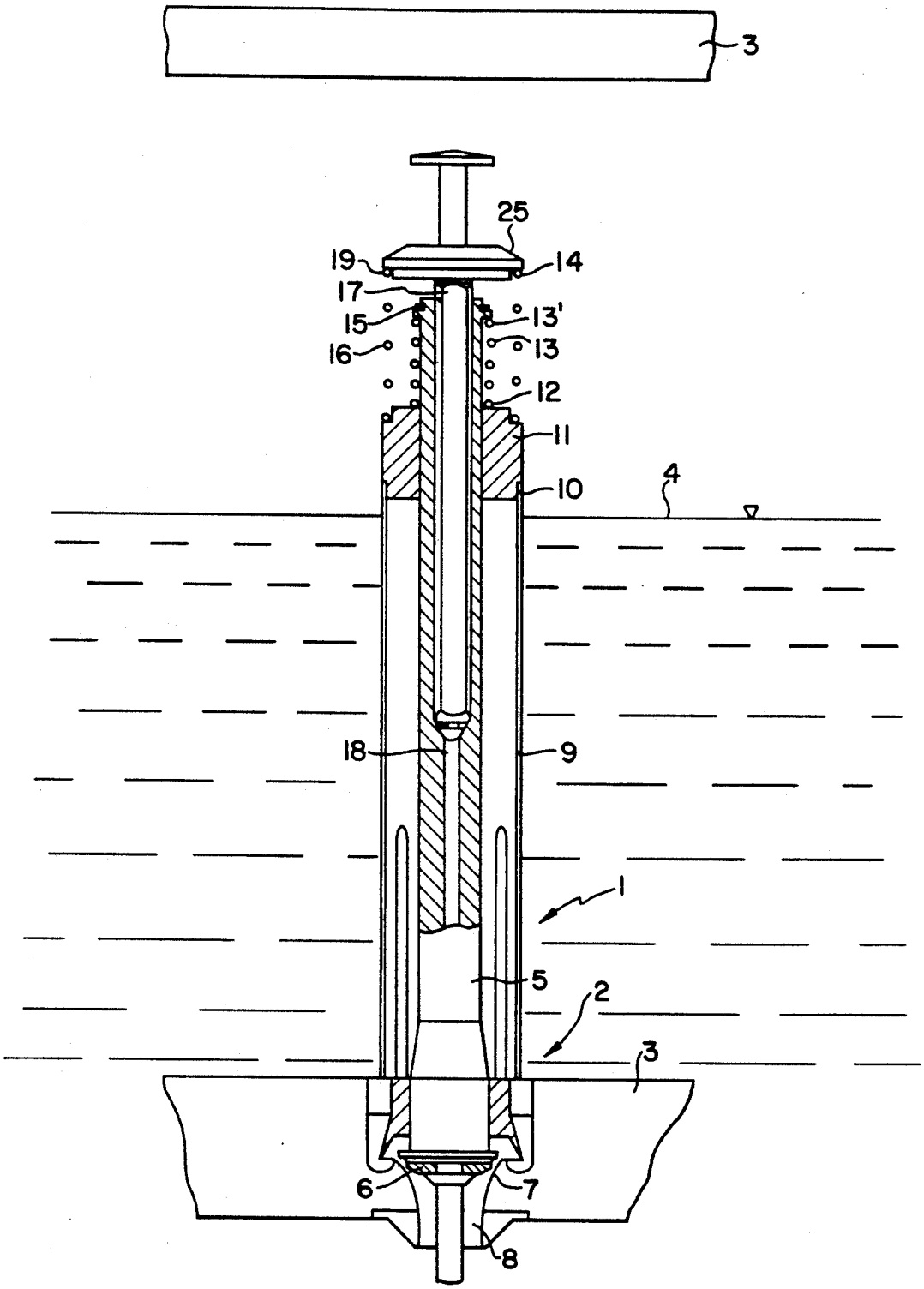
FIG. 1 illustrates, in a side view, a filling apparatus in which the apparatus which is the subject of the present invention is utilized.

In FIG. 1 the filling apparatus 1 is located within a filling vessel 3 and extends upwardly from the base 2 of the vessel. The vessel has a liquid level 4 located above the base 2. Filling apparatus 1 includes an upwardly extending valve body 5 movable in the upward direction and having a seal 6 at its lower end in contact with a valve seat 7 when the filling apparatus 1 is in the closed position. Valve seat 7 is located in the base 2 of the vessel 3 and a liquid outlet channel 8 extends downwardly from the vessel and may be formed as part of the filling apparatus 1 or as a part of the filling vessel 3 laterally enclosing and spaced outwardly from the valve body 5 with its lower end at the base 2 and with its upper end 10 located above the maximum expected liquid level 4. A stationary abutment element 11 is mounted on the upper end 10 and extends upwardly therefrom. A spring 13 of the movable valve body 5, affording a weight compensation, bears at its lower end 12 against the abutment element 11. Upper end 13' of the spring 13 bears against an abutment face 15 at the upper end of the valve body 5. In addition, another spring 16 encircles the valve body and is spaced outwardly from the spring 13. Spring 16 bears at its lower end against the abutment element 11 and at its upper end 14 against an abutment 19 for the gas valve shaft 17 located within the valve body 5. The spring 16 serves to activate a gas line 18 located within the valve body 5. A mushroom-like body 25, as shown in FIG. 1, is attached above the gas valve shaft 17 and engages a finger (not shown) which is controllable from an external actuating device (not shown). The finger is actuated by the external actuating device which raises the finger. The raising of the finger results in a mechanical unloading of the gas valve shaft 17 thereby enabling the gas valve shaft 17 to be lifted by the spring 16. The pressurized or compressed gas, which is located above the liquid level 4, can then flow into the bottom through the bore 18 until it has reached the pipe end and practically closes same off, so that no further gas exchange can occur in the direction of the filling machine or reservoir.

As shown in FIG. 1 the liquid level 4 is located below the entire spring system, whereby optimum flow conditions are available in the region of the filling apparatus and the liquid outlet channel 7, so that such flow conditions are not effected by these parts above the liquid level. The tubular member 9 has slots extending upwardly from the base 2 of the vessel to a point below the liquid level so that the liquid can flow into the outlet channel 8. Instead of the arrangement of the springs 13, 16 as shown in FIG. 1, they could also be supported at appropriately designed location within the vessel.

While specific embodiments of the invention have been shown and described in detail to illustrate the application of the inventive principles, it will be understood that the invention may be embodied otherwise without departing from such principles.

We claim:

1. An apparatus for filling liquid into containers subject to counter pressure which comprises:

a vessel for the liquid having a base portion and a top portion, wherein said vessel has a liquid level which is spaced upwardly from said base portion and downwardly from said top portion of said vessel and further wherein liquid enters said vessel through said portion;

a liquid outlet channel which is located in said base portion of said vessel;

a valve seat which is located in said liquid outlet channel;

an valve body which extends upwards and which is located within said vessel and having a lower end of said valve seat and an upper end above said liquid level wherein said valve body is movable upwardly under spring pressure from said valve seat;

a first spring which is located in said vessel at said valve body and wherein said first spring, in the course of pressure equalization between a container and the vessel compensates for the weight of said valve body;

a tubular member laterally enclosing said valve body to a height above said liquid level;

a stationary abutment element mounted on and extending upwardly from the upper end of said tubular member wherein said first spring laterally encircles said valve body above said liquid level and bears at a lower end of said abutment element and at an upper end against an abutment face on said valve body spaced upwardly from said abutment element.

2. The apparatus of claim 1 further comprising:

a second spring which is located around and spaced outwardly from said first spring and bears at a lower end against said abutment element and at an upper end against a gas valve shaft of a gas line which is located within said valve body.

* * * * *